US007779584B2

(12) United States Patent
Arias

(10) Patent No.: US 7,779,584 B2
(45) Date of Patent: Aug. 24, 2010

(54) CURTAIN WALL SYSTEM

(75) Inventor: Augusto Arias, Le Gardeur (CA)

(73) Assignee: Muridal Inc., Le Gardeur (CA)

( * ) Notice: Subject to any disclaimer, the term of this patent is extended or adjusted under 35 U.S.C. 154(b) by 288 days.

(21) Appl. No.: 11/076,152

(22) Filed: Mar. 8, 2005

(65) Prior Publication Data

US 2006/0201084 A1 Sep. 14, 2006

(51) Int. Cl.
*E04H 1/00* (2006.01)

(52) U.S. Cl. ..... 52/235; 52/204.591; 52/204.597; 52/461; 52/463; 52/668

(58) Field of Classification Search ..... 52/235, 52/204.597, 204.593, 204.591, 204.62, 463, 52/461, 469, 668
See application file for complete search history.

(56) References Cited

U.S. PATENT DOCUMENTS

| | | | | | |
|---|---|---|---|---|---|
| 3,081,849 | A | * | 3/1963 | Hubbard | 52/464 |
| 3,266,210 | A | * | 8/1966 | Grossman | 52/690 |
| 3,321,880 | A | * | 5/1967 | Ferrell et al. | 52/235 |
| 3,734,550 | A | * | 5/1973 | Vance | 403/34 |
| 3,866,369 | A | | 2/1975 | Paull | |
| RE30,432 | E | | 11/1980 | Stoakes | |
| RE31,955 | E | | 7/1985 | Shiga et al. | |
| 4,584,804 | A | * | 4/1986 | Tajima | 52/235 |
| 4,611,447 | A | | 9/1986 | Krechel | |
| 4,638,613 | A | | 1/1987 | Tönsmann | |
| 4,650,702 | A | * | 3/1987 | Whitmyer | 428/31 |
| 4,974,385 | A | | 12/1990 | McFadden et al. | |
| 5,067,293 | A | * | 11/1991 | Reynolds | 52/235 |
| 5,177,921 | A | | 1/1993 | Dempster | |
| 5,235,790 | A | | 8/1993 | Ishikawa et al. | |
| 5,452,552 | A | | 9/1995 | Ting | |
| 5,483,775 | A | | 1/1996 | Redman | |
| 5,687,524 | A | * | 11/1997 | Ting | 52/461 |
| 5,839,236 | A | * | 11/1998 | Frey | 52/235 |

(Continued)

FOREIGN PATENT DOCUMENTS

| | | |
|---|---|---|
| CA | 987879 | 4/1976 |

(Continued)

OTHER PUBLICATIONS

International Search Report, Jun. 30, 2006, Arias, August.

*Primary Examiner*—Brian E Glessner
*Assistant Examiner*—Adriana Figueroa
(74) *Attorney, Agent, or Firm*—Carter, Schnedler & Warnock, P.A.

(57) ABSTRACT

A curtain wall system having a framing of mullions and transoms. The mullions have a mullion body portion and a mullion nose portion and spaced notches in the mullion body portion. The penetrating transom have a transom body portion and a transom nose portion. The transom nose portion has extensions extending beyond opposed ends of the transom body portion received in the notches of the mullion body portions whereby the framing portion is formed for sealing receiving a panel to form an air barrier, with a gap being defined between the extensions of the transoms and the mullion nose portions. Pressure plates are connected to the mullions and transoms to form a sash with the framing portion so as to secure the panels within the sash. A seal member blocks each gap to form a pressurized cavity with the sash about the glass panel.

8 Claims, 6 Drawing Sheets

U.S. PATENT DOCUMENTS

| | | | | |
|---|---|---|---|---|
| 5,893,244 | A | 4/1999 | Magoon | |
| 6,715,248 | B2 | 4/2004 | Biebuyck | |
| 6,804,920 | B2 | 10/2004 | Hogan | |
| 2002/0124499 | A1 * | 9/2002 | Braybrook | 52/235 |
| 2003/0226324 | A1 * | 12/2003 | Hogan | 52/235 |
| 2004/0031220 | A1 | 2/2004 | Hocker et al. | |
| 2004/0045235 | A1 | 3/2004 | Ley et al. | |

FOREIGN PATENT DOCUMENTS

| | | | |
|---|---|---|---|
| CA | 2 430 058 | | 7/2002 |
| EP | 0 799 945 | A1 | 10/1987 |
| EP | 0 451 537 | B1 | 10/1993 |
| EP | 0 436 868 | B1 | 5/1995 |
| WO | WO 87/06291 | | 10/1987 |
| WO | WO 91/12390 | | 8/1991 |
| WO | WO 2004/042159 | | 5/2004 |

* cited by examiner

CURTAIN WALL SYSTEM

TECHNICAL FIELD

The present invention generally relates to curtain wall systems and, more particularly, to a connection between structural members of the curtain wall in a rain-screen type of curtain wall system.

BACKGROUND ART

Curtain walls are widely used as exterior sheathing of buildings, especially of the commercial or institutional type. Curtain walls consist of glass panels constituting a major portion of the exterior surface of the building, with structural members separating the glass panels.

The structural members typically form a grid consisting of mullions (i.e., vertical members) and transoms (i.e., horizontal members). Panels are sealingly received between sets of mullions and transoms and supported thereby, so as to define the exterior sheathing of the building. In a rain-screen type of curtain wall system (zone drainage system), the framing about each glass panel defines a cavity between inner structural members and outer structural members. The inner structural members form a rain screen with the glass panel. The pressurized cavity between the inner and outer structural members defines a pressure zone of a pressure generally equal to that exerted on the outer structural member. The pressurized cavity is ventilated so as to allow air to enter or exit the cavity, in order to equalize the pressure in the cavity to the pressure at the exterior of the curtain wall. Accordingly, pressure increases, for instance due to wind or like atmospheric conditions, will be neutralized by the pressure zone and thus not cause infiltration through the rain screen.

However, curtain wall systems are still subject to water/air infiltration. Water/air infiltration through structural members is often through the intersection between the transoms and the mullions. More specifically, according to the type of construction of the mullions and the transoms, a caulking joint is often made between interconnected pieces. The caulking joint between the adjacent pieces seals off interface between interconnected pieces and is responsible for the water/air tightness of the curtain wall.

The efficiency of the tightness is related to the quality of joint being made between the interconnected structural members. As the sealing joints are made manually, and are exposed to great temperature variations and severe weather conditions, the water/air tightness of curtain wall systems is often inadequate such that there is infiltration.

Other constructions of structural members for curtain walls include a protrusion at ends of the transoms, which protrusions are received in corresponding notches in the mullions and are referred to as "penetrating transoms". For instance, U.S. Patent Application No. 2004/0031220, by Hocker et al. and as published on Feb. 19, 2004 illustrates this type of configuration. The interconnection between the penetrating transom and the mullion reduces the risk of infiltration through the interface between the transoms and mullions.

In such systems, water collected by the transoms is drained by the effect of gravity and by the draining configuration of the structural members. More specifically, the transoms are positioned such that water accumulated thereon is drained toward the mullions. Accordingly, vertically adjacent sashes formed of structural members around a panel must be in fluid communication with one another so as to allow drainage of water on the surface of the mullions. Therefore, it is difficult to maintain a pressure equalization between the sash of a panel (i.e., a zone) and the surrounding pressure as all sashes communicate with one another. At present, systems with penetrating mullions are not used in rain-screen type of curtain wall systems due to the absence of isolated pressurized cavity about each panel.

SUMMARY OF INVENTION

It is a feature of the present invention to provide a novel curtain wall system.

It is a further feature of the present invention to provide a curtain wall system which addresses the above issues.

Therefore, in accordance with the present invention, there is provided a curtain wall system of the type having a framing of mullions and transoms adapted to support panels, the curtain wall system comprising: framing portions for supporting the glass panels, each framing portion being formed by: a pair of horizontally spaced apart mullions, each said mullion having a mullion body portion and a mullion nose portion projecting from the mullion body portion, a pair of vertically spaced notches in the mullion body portion; and a pair of vertically spaced apart penetrating transoms, each said penetrating transom having a transom body portion and a transom nose portion projecting from the transom body portion, the transom nose portion having extensions extending beyond opposed ends of the transom body portion, the extensions being received in the notches of the mullion body portions such that the penetrating transoms are supported by the mullions, whereby the framing portion is formed for sealing receiving a panel to form an air barrier, with a gap being defined between the extensions of the transoms and the mullion nose portions; pressure plates connected to the mullion nose portions and to the transom nose portions to form a sash with the framing portion so as to secure the panel within the sash; and a seal member blocking each said gap to form a pressurized cavity with the sash about the glass panel, whereby a rain screen is formed by the combination of the air barrier and the pressurized cavity.

Further in accordance with the present invention, there is provided a curtain wall system of the type having a framing of mullions and transoms adapted to support panels, the curtain wall system comprising: framing portions for supporting the panels, each framing portion being formed by: a pair of horizontally spaced apart mullions, each said mullion having a mullion body portion and a mullion nose portion projecting from the mullion body portion, a pair of vertically spaced notches in the mullion body portion and channels with longitudinal tapping in the mullion body portions; and a pair of vertically spaced apart penetrating transoms, each said penetrating transom having a transom body portion and a transom nose portion projecting from the transom body portion, the transom nose portion having extensions extending beyond opposed ends of the transom body portion, the extensions being received in the notches of the mullion body portions such that the penetrating transoms are supported by the mullions, whereby the framing portion is formed for sealing receiving a panel to form an air barrier; fasteners passing through the extensions to screwingly engage with the longitudinal tapping so as to secure the transoms to the mullions; and pressure plates connected to the mullion nose portions and to the transom nose portions to form a sash with the framing portion so as to secure the panel within the sash.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
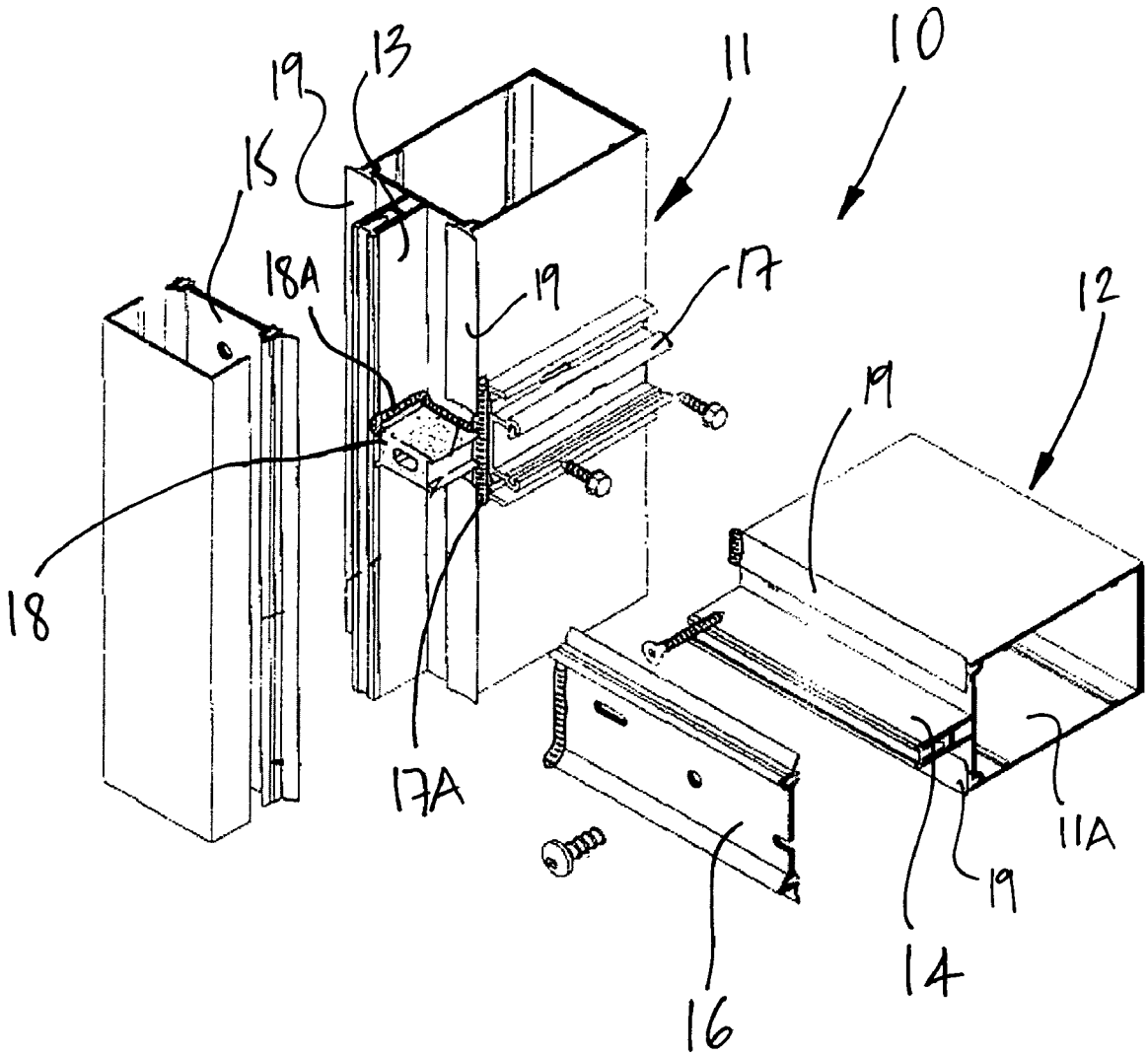
Fig. 1 (PRIOR ART)
FIG. 1 is an exploded view of a rain-screen type of curtain wall framing in accordance with the prior art.

Referring to FIG. 1, a first type of curtain wall framing in accordance with the prior art is generally shown at 10. FIG. 1 shows an interrelation between a mullion 11 and a transom 12. Both the mullion 11 and the transom 12 are extruded members, respectively provided with shoulders 13 and 14, so as to support a glass panel (not shown) Pressure plates 15 and 16 respectively connect to the shoulders 13 and 14, thereby defining a sash in which the glass panel is held captive.

The transom 12 is secured to the mullion 11 by connector bracket 17. The connector bracket 17 is firstly secured to the mullion 11, for instance using fasteners. The connector bracket 17 is thereafter accommodated within an inner cavity 11A of the transom 11.

In order to form an air barrier, the interface between the mullion 11 and the transom 12 is sealed by way of a sealing joint 17A made between the connector bracket 17 and the mullion 11. Accordingly, once a glass panel is received against the shoulders 13 and 14, an air barrier will be created by the contact of the glass panel with the gaskets 19, and by the sealing joint 17A between the mullion 11 and the transom 12.

In order to define a pressurized cavity about the glass panel, a sealing plug 18 is also provided and squeezed between the shoulders 13 and 14. A sealing joint 18A is made about the periphery of the sealing plug 18. A pressurized cavity is therefore defined about each glass panel, and as such, the combination of the air barrier and of the pressurized cavity forms a rain screen.

Figure 2:
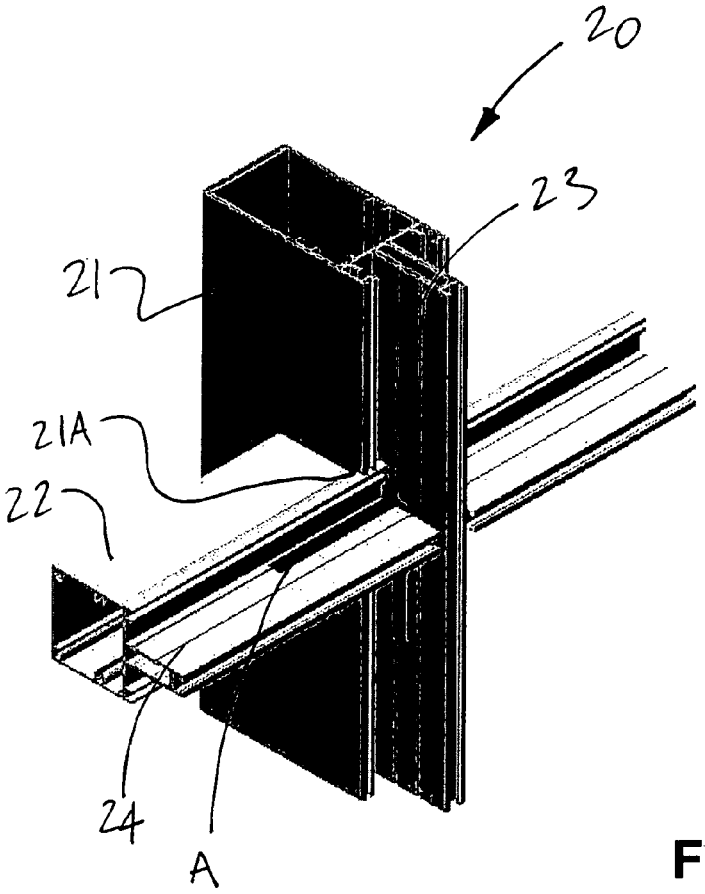
Fig. 2 (PRIOR ART)
FIG. 2 is an exploded view of a mullion-drainage type of curtain wall framing in accordance with the prior art.

Referring to FIG. 2, a mullion drainage type of curtain wall framing also in accordance with the prior art is generally shown at 20. FIG. 2 shows an interrelation between a mullion 21 and a penetrating transom 22. Both the mullion 21 and the transom 22 are extruded members, respectively provided with shoulders 23 and 24, so as to support a glass panel (not shown). Pressure plates (not shown) connect to the shoulders 23 and 24, thereby defining a sash in which the glass panel is held captive.

As shown in FIG. 2, the mullion 21 defines a notch 21A, in which an extension 22A of the penetrating transom 22 is received. Fasteners (not shown) such as bolts or the like are used to secure the transoms 22 to the mullion 21.

As opposed to rain-screen type curtain wall systems, water (e.g., rain received on the surface of the glass panels) is drained by the shoulders 24 of the transoms 22 in this type of curtain wall framing. The shoulders 24 of the transoms 22 are typically oriented so as to cause a drainage of water toward the mullions 21 (i.e., mullion drainage), as illustrated by A in FIG. 2.

The penetrating transoms 22 contact the mullions 21 on a pair of surfaces due to the configuration of the extension 22A, and this results in lower water/air infiltration at the interface between the mullions 21 and transoms 22. The interface between the mullions 21 and the transoms 22 is not directly exposed to winds.

Figure 4:
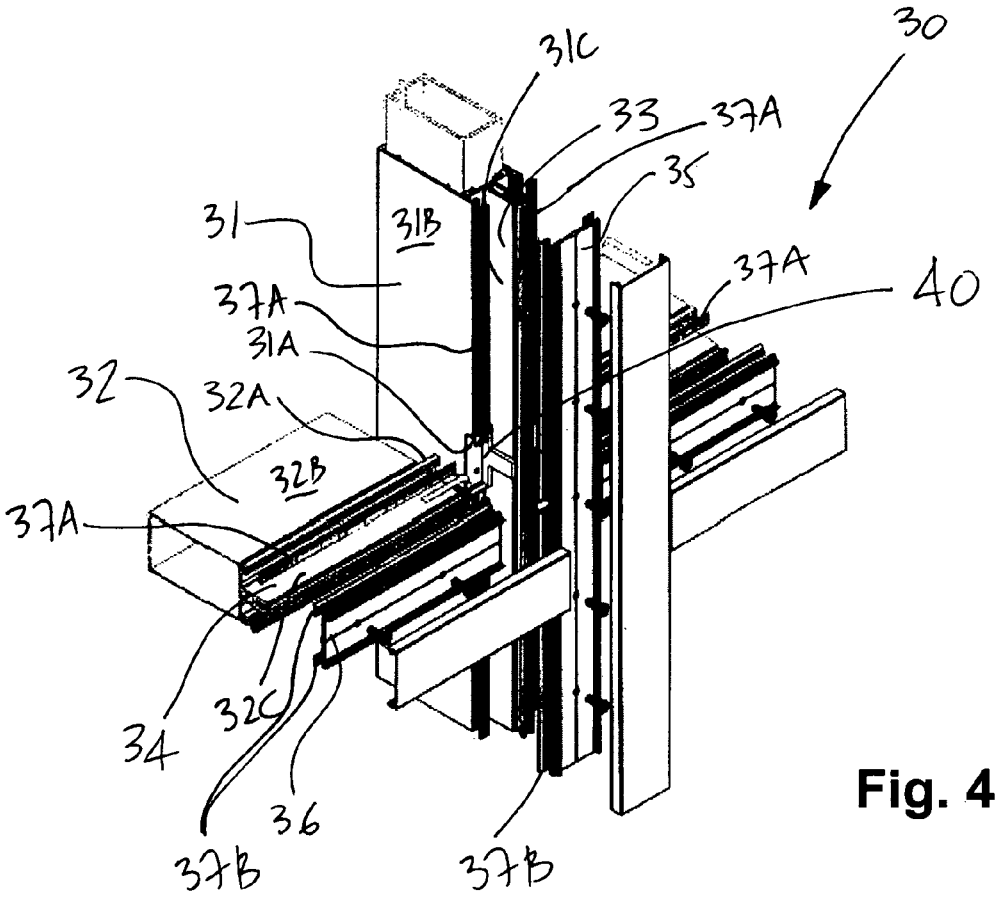
FIG. 4 is an exploded view of the curtain wall framing in accordance with the preferred embodiment of the present invention.
Figure 9:
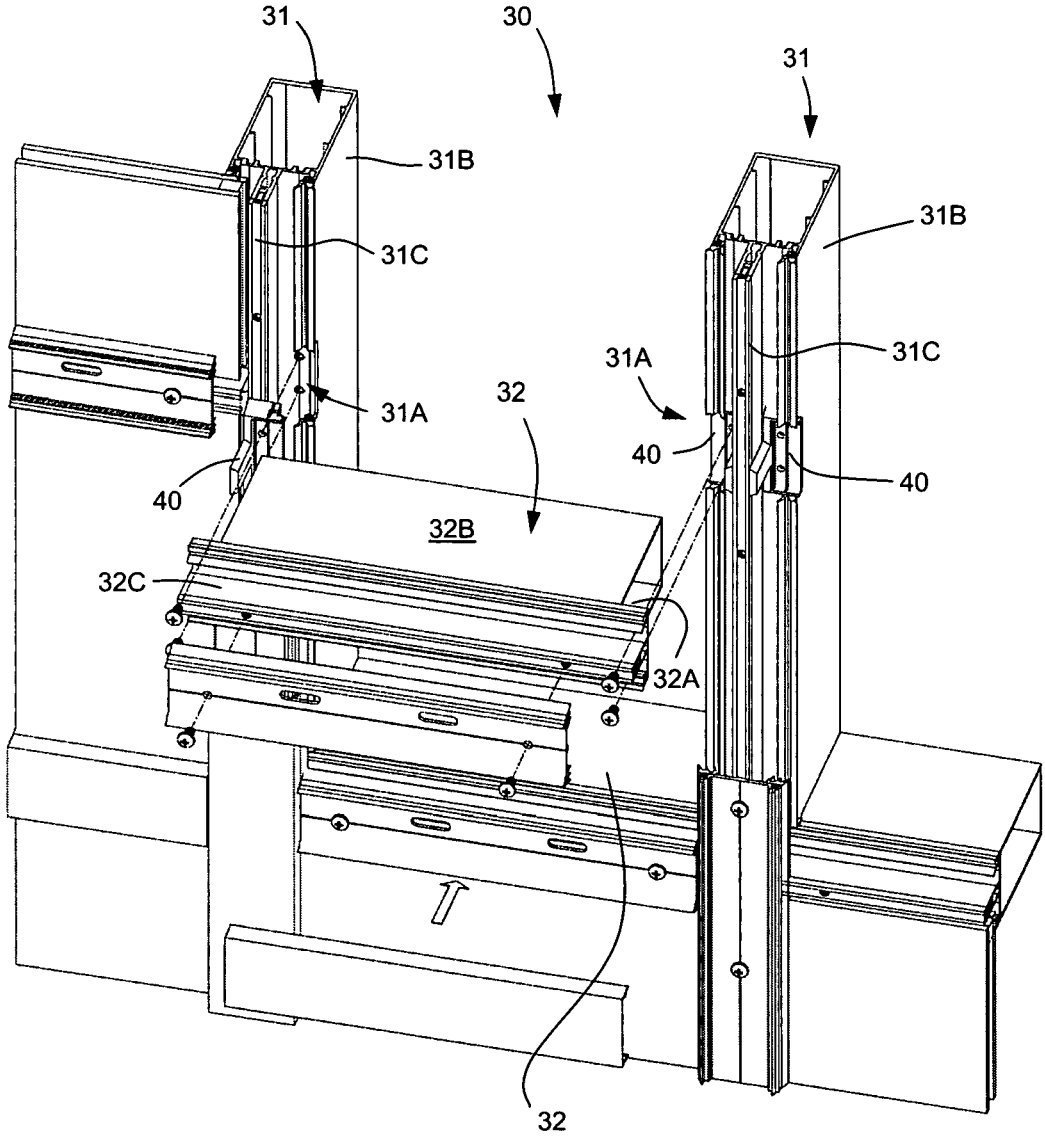
FIG. 9 is an assembly view, sectioned of framing portions of a certain wall in accordance with the preferred embodiment.

Referring to FIGS. 4 and 9, a curtain wall framing in accordance with a preferred embodiment of the present invention is generally shown at 30. The curtain wall framing 30 is similar to the curtain wall framing 20 of FIG. 2, in that mullions are notched for receiving extensions of penetrating transoms. However, the curtain wall framing 30 also provides zone drainage similarly to the rain-screen type of curtain wall system 10 of FIG. 1.

Figure 5:
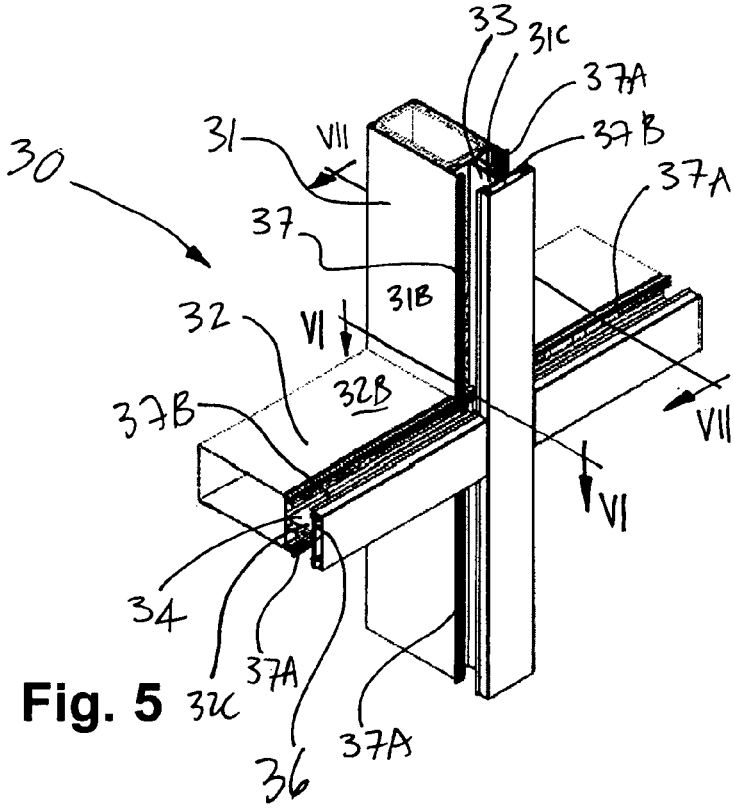
FIG. 5 is a perspective view of the curtain wall framing of FIG. 4, without glass panels.

More specifically, a mullion 31 consisting of a body 31B and a nose 31C is shown having a notch 31A, whereas a penetrating transom 32 consisting of a body 32B and a nose 32C is shown having an extension 32A. The nose 31C of the mullion 31 has a shoulder 33, which is associated to a shoulder 34 of the nose 32C of the penetrating transom 32, so as to support a panel (e.g., glass panel). Pressure plates 35 and 36 are respectively secured thereafter to the mullion 31 and transom 32, thereby defining a sash in which the glass panel (not shown) is held captive as is well illustrated in FIG. 5. Penetrating transoms 32 are supported by vertically spaced apart notches, with one level of notches 31A illustrated in FIG. 9.

The curtain wall system 30 defines a rain screen that is substantially sealed from water/air infiltration. More specifically, gaskets 37A are provided adjacent to the shoulders 33 and 34, so as to contact the glass panel when the latter is received in the sash formed of mullions 31, transoms 32 and pressure plates 35 and 36. Moreover, by the penetration of the extension 32A of the transom 32 in the notch 31A of the mullion 31, a generally watertight air barrier is formed by the framing 30 and the glass panel (not shown in FIG. 4). A gap is defined between the extension 32A and the body 31B and nose 31C of the mullion 31. In the illustrated embodiment, the gap has an L-shaped geometry.

Similarly to zone drainage systems, the curtain wall system 30 defines pressure zone cavities about each glass panel, so as to reduce the risk of infiltration. In order to create a pressurized cavity for each glass panel, a sealing member 40 is provided, as shown in FIGS. 3 and 4.

Figure 3:
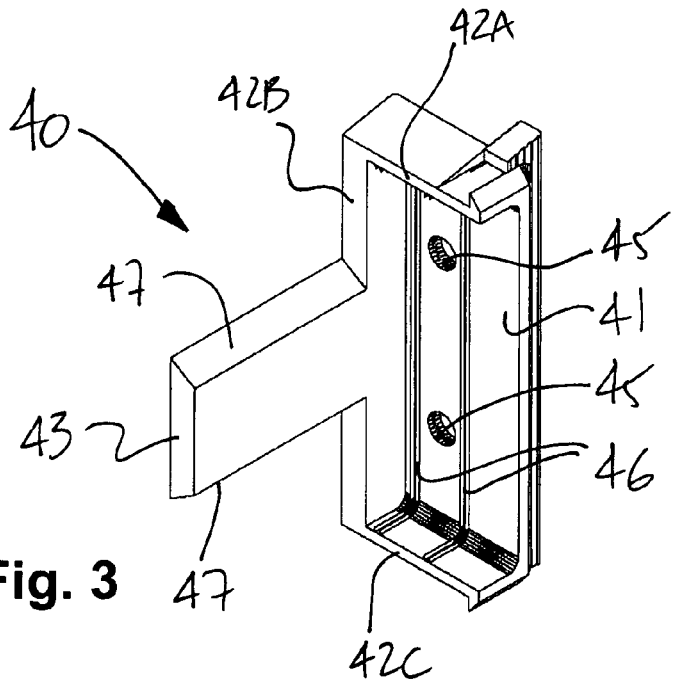
FIG. 3 is a perspective view of a sealing member used in a curtain wall framing in accordance with a preferred embodiment of the present invention.

Referring to FIG. 3, the sealing member 40 has a generally planar base 41. Walls 42A, 42B and 42C project from three sides of the periphery of the base 41. A finger 43 extends from the wall 42B, whereas a flange 44 projects from an opposed surface of the base 41. A pair of through bores 45 extend through the base 41. A pair of sealing ribs 46 is provided in the planar base 41, and is generally parallel to the wall 42B. It is pointed out that the through bores 45 are positioned between the ribs 46. Sides 47 of the finger 43 are angulated. The sealing member 40 is preferably made of a polymeric material or like rubbery material, adapted to withstand temperature variations.

Figure 7:
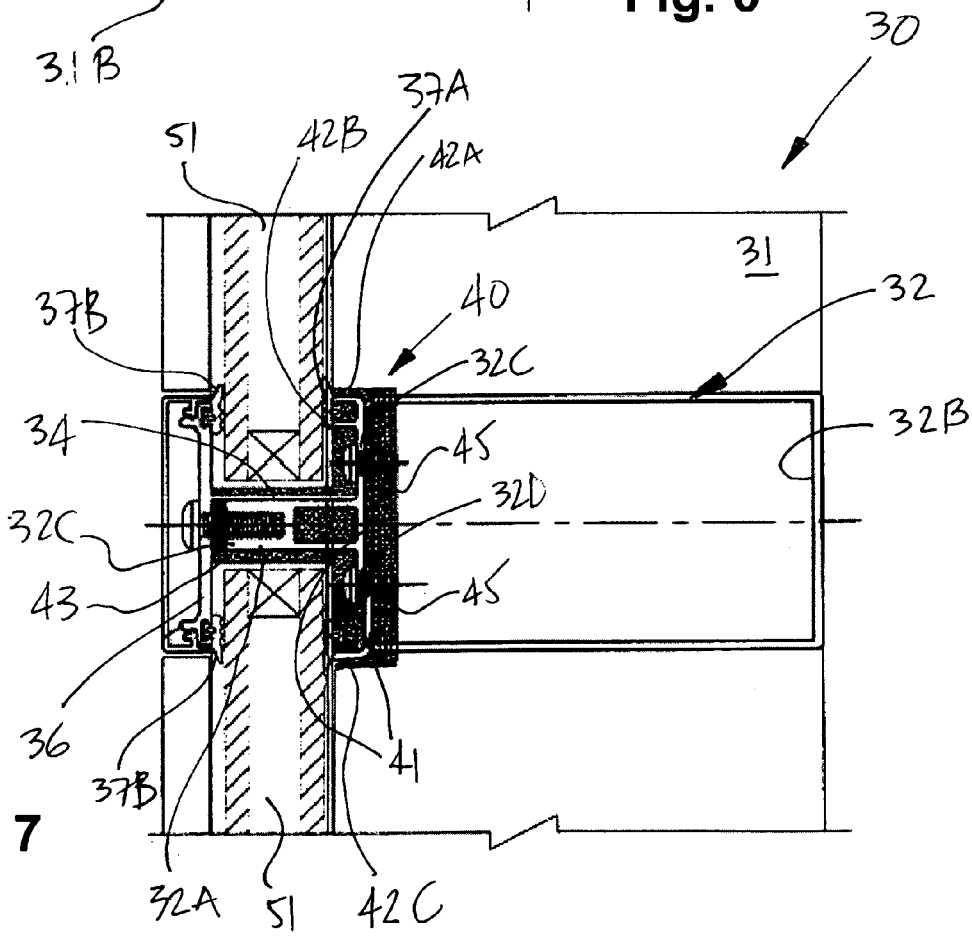
FIG. 7 is a cross-section view taken along cross-section lines VII-VII of the curtain wall framing of FIG. 5, with glass panels added.

As seen in FIGS. 3 and 7, the distance between the walls 42A and 42C of the base 41 is such that a rear face 32B of the extension 32A is snugly accommodated within the depression formed by the base 41 and the walls 42. Accordingly, the extension 32A is received in the notch 31A of the mullion 31 with the base 41 squeezed therebetween.

In order to form the pressurized cavity about the panel, the sealing member 40 is lodged in the gap between the mullions 31 and transoms 32.

Figure 6:
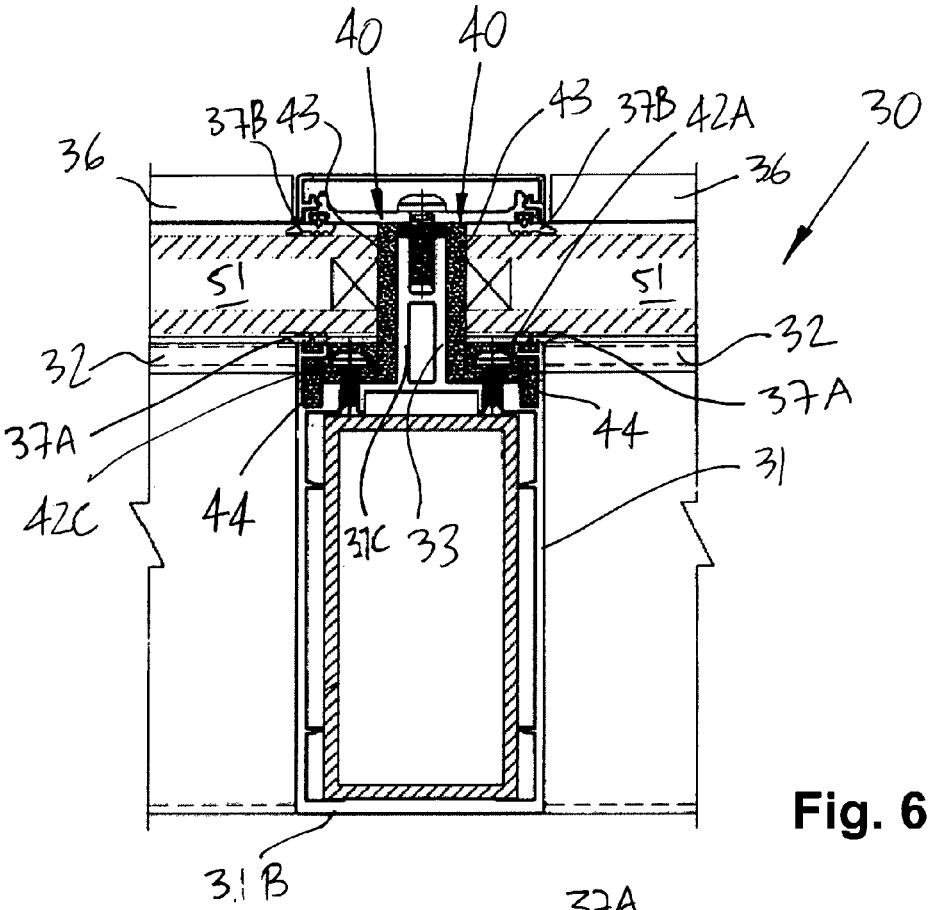
FIG. 6 is a cross-section view taken along cross-section lines VI-VI of the curtain wall framing of FIG. 5, with glass panels added.

As seen in FIGS. 4 and 6, the finger 43 is sized so as to be sandwiched between the shoulder 34 of the transom 32 and the shoulder 33 of the mullion 31. By way of the finger 43 squeezed between the shoulders 33 and 34, the spaces between shoulders 33 and 34 are sealed off in view of forming a pressurized cavity about each glass panel 51. Once the pressure plates 35 and 36 complete the sash about the glass panel 51, gaskets 37B (FIGS. 4 to 7) contact the glass panel 51. A pressurized cavity is therefore formed by the gaskets 37A and 37B. The cavity is sealed off, as mentioned previously, by the fingers 43 squeezed between the shoulders 33 and 34.

In order to have the pressure within the pressurized cavity adapt to the outdoor pressure, air infiltration is permitted through the pressure plates 35 and 36, as is known for rainscreen type curtain wall systems. Accordingly, a rain screen is formed by the combination of the air barrier and of the pressurized cavity.

As seen in FIG. 6, the flange 44 is received in a channel 50 of the mullion 31. Through bores 32D (FIGS. 6 and 7) are preferably provided in the extension 32A, and are positioned so as to be aligned with the through bores 45 in the sealing member 40. The transoms 32 are secured to the mullions 31 by fasteners received in the through bores 32D. Accordingly, in addition to the penetrating configuration, which minimizes infiltration, the member 40 accommodates the extension 32A of the transom 32, so as to reduce further the risks of infiltration at the interface between the mullions 31 and transoms 32. The sealing ribs 46 prevent infiltration through the through bores 32D.

Figure 8:
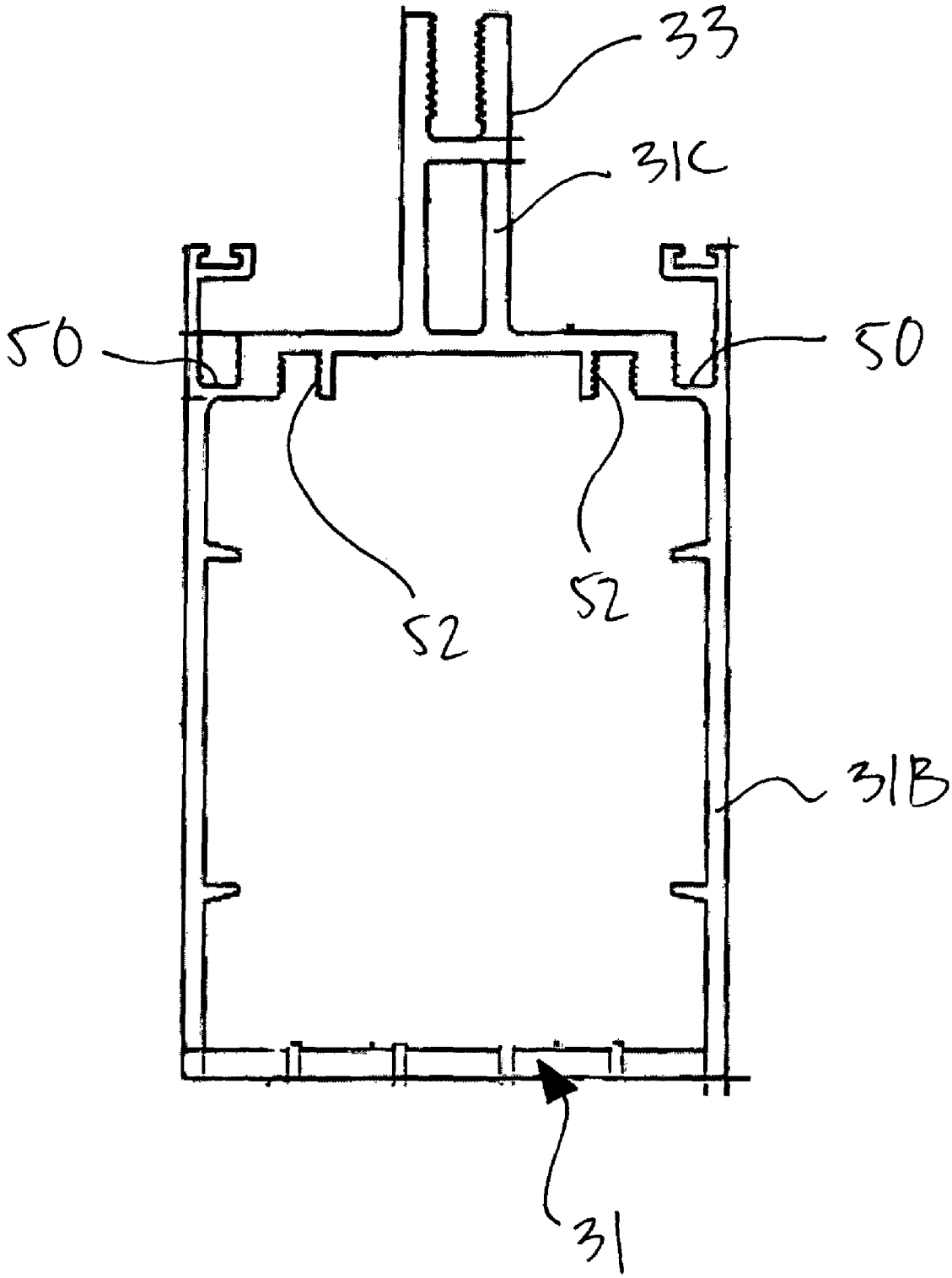
FIG. 8 is a cross-section view of a mullion of the curtain wall framing of FIG. 5.

Referring to FIGS. 6 and 8, the mullion 31 is shown having channels 52 in its inner cavity. The channels 52 are provided with longitudinal tapping, so as to cooperate with the fasteners used to secure the transoms 32 to the mullions 31. This configuration advantageously allows for a worker to fasten the transoms to the mullions 31 from a frontal position, as opposed to the curtain wall framing of the prior art.

It is within the ambit of the present invention to cover any obvious modifications of the embodiments described herein, provided such modifications fall within the scope of the appended claims.

The invention claimed is:

1. A curtain wall system of the type having a framing of mullions and transoms adapted to support panels, the curtain wall system comprising:

framing portions for supporting the glass panels, each framing portion being formed by:

a pair of horizontally spaced apart mullions, each said mullion having a mullion body portion and a mullion nose portion projecting from the mullion body portion, a pair of vertically spaced notches in the mullion body portion; and a pair of vertically spaced apart penetrating transoms, each said penetrating transom having a transom body portion and a transom nose portion projecting from the transom body portion, the transom nose portion having extensions extending beyond opposed ends of the transom body portion with the transom body portion, the transom nose portion and the extensions forming one integral extruded member, the extensions being received in the notches of the mullion body portions such that the penetrating transoms are supported by the mullions, whereby the framing portion is formed for sealingly receiving a panel to form an air barrier, with the mullion nose portions and the transom nose portions about the glass panel, and with a gap being defined between the extensions of the transoms and the mullion nose portions;

pressure plates releasably connected to the mullion nose portions and to the transom nose portions to form a sash with the framing portion so as to hold the panel laterally captive between the mullion body portions, the transom body portions and the pressure plates; and an integrally-formed seal member blocking each said gap to form a pressurized cavity with the sash about the glass panel, whereby a rain screen is formed by the combination of the air barrier and the pressurized cavity.

2. The curtain wall system of claim 1, wherein each said seal member is squeezed between an end surface of the extension and a surface of the mullion nose portions.

3. The curtain wall system according to claim 1, wherein each said gap has an L-shaped geometry between the extensions of the transoms, and the mullion nose portions and the mullion body portions, the sealing member having a corresponding shape so as to be squeezed between the extensions of the transoms, and the mullion nose portions and the mullion body portions.

4. The curtain wall system according to claim 3, wherein the sealing member abuts against an interface between the extension and the periphery of the notch.

5. The curtain wall system according to claim 3, wherein bores are provided in a portion of the sealing member between the extension and the mullion body portion, with fasteners used through said bores to secure the transom to the mullion.

6. The curtain wall system according to claim 5, wherein ribs are provided in the sealing member to prevent fluid infiltration through the bores.

7. The curtain wall system according to claim 1, wherein fasteners secure the extensions of the transoms to the mullion body portions.

8. The curtain wall system according to claim 7, wherein channels with longitudinal tapping are provided in the mullion body portions so as to screwingly cooperate with the fasteners.

* * * * *